United States Patent [19]

Schnell

[11] Patent Number: 4,709,920

[45] Date of Patent: Dec. 1, 1987

[54] EXERCISING APPARATUS

[76] Inventor: Josef Schnell, Sportweg 9, Ortsteil Peutenhausen, 8899 Gachenbach, Fed. Rep. of Germany

[21] Appl. No.: 866,217

[22] Filed: May 22, 1986

[30] Foreign Application Priority Data

Nov. 9, 1985 [DE] Fed. Rep. of Germany ..... 3539796

[51] Int. Cl.[4] ..... A63B 21/06

[52] U.S. Cl. ..... 272/117; 272/118; 272/DIG. 4

[58] Field of Search ..... 272/117, 118, 120, 122, 272/123, 134, DIG. 4, 142, 143, 901, 136

[56] References Cited

U.S. PATENT DOCUMENTS

| | | | |
|---|---|---|---|
| 3,171,652 | 3/1965 | Newman | 272/123 |
| 4,563,003 | 1/1986 | Bugallo et al. | 272/118 |
| 4,600,189 | 7/1986 | Olschansky et al. | 272/118 |
| 4,621,807 | 11/1986 | Stramer | 272/118 X |
| 4,625,959 | 12/1986 | Schleffendorf | 272/118 |
| 4,627,616 | 12/1986 | Kauffman | 272/120 |
| 4,648,594 | 3/1987 | Schleffendorf | 272/118 |

FOREIGN PATENT DOCUMENTS

| | | | |
|---|---|---|---|
| 3403180 | 8/1985 | Fed. Rep. of Germany | 272/118 |

*Primary Examiner*—Richard J. Apley
*Assistant Examiner*—Robert W. Bahr
*Attorney, Agent, or Firm*—Henry M. Feiereisen

[57] ABSTRACT

An exercising apparatus for training the muscles of a human body includes a frame supporting a crank on a shaft which is attached to a pair of identical disks. The disks define several cam paths along which a cable is guided whose other end is connected to a stack of weight plates. By guiding the cable about the various cam paths, each muscle can be exercised in each phase of motion according to its capability in view of the respectively changing moment arms.

17 Claims, 6 Drawing Figures

EXERCISING APPARATUS

FIELD OF THE INVENTION

The present invention refers to an exercising apparatus for working out the muscles of a human body.

BACKGROUND OF THE INVENTION

Exercising apparatus, weight lifting machines or rehabiliation machines are frequently used to improve the overall health, fitness and constitution of the human body. One disadvantage of these machines is their limitation to exercise a muscle without considering its specific physical conditions during various stages of motion. Thus, the muscle is inevenly trained rendering the use of such machines on a competitive level or during rehabilitation less favorable. Moreover, these machines are usually designed for exercising either the arm or the leg so that a variety of exercising machines is necessary to work out all different kinds of muscles or at least complicated modifications of these machines are required to achieve a desired versatility.

OBJECT OF THE INVENTION

Hence, the primary object of the present invention is to provide an improved exercising apparatus obviating the afore-stated drawbacks.

SUMMARY OF THE INVENTION

This object is realized in accordance with the present invention by interposing between weight plates and a user-actuated member an adjustable intermediate support which provides varying moment arms and is variable in its position with respect to the user-actuated member in order to allow each muscle of a human body to be exercised according to its capability in each phase of motion.

The user-actuated member is constituted by a crank which is connected to a shaft support by the frame of the exercising apparatus. The intermediate support defines a plurality of cam paths which provide varying effective moment arms during lifting of the weight plates via a respective cable. Since the shape of the cam paths is adapted to the capability of each muscle to be exercised during the various phases of motion, the danger of overstrain during one phase or understrain during another phase is prevented. This means that in the various stages during which the muscle strength of the arm or leg varies, the effective moment arms are altered as well so that the weight as provided by the plates affects the user differently when actuating the crank.

Through the provision of such an exercising apparatus with a variety of cam paths adapted to each muscle, optimal results can be achieved as a training over the entire tensional and relaxing range of each muscle is possible. The shape or course of each cam path is exactly adapted to the strength of each muscle and thus reflects the different conditions thereof.

The cam paths of the intermediate support is represented by a plurality of locking pins which are insertable in aligned holes of a pair of indentical disks arranged in spaced-apart relationship and supported on the shaft. Thus, the exercising apparatus allows a training of all muscles without necessitating complicated modifications. This is achieved by simply inserting the pins along the desired cam path. As the holes and thus the locking pins can be arranged in any arbitrary manner, practically all occurring forces can be simulated and therefore every user be it a professional or an untrained individual can adjust the exercising apparatus to his or her particular needs.

Preferably, the individual cam paths as defined by the locking pins are differently marked to indicate to the user which cam path is to be used for training a specific muscle. The marking can be done in various manners e.g. by using color strips, adhesive tapes, grooves, beads etc. It is also possible to simply name the various cam paths with the respective muscle or to describe the meaning of colors, grooves etc. on a portion of the frame.

BRIEF DESCRIPTION OF THE DRAWING

The above objects, features and advantages of my present invention will now be described in more detail with reference to the accompanying drawing in which.

Figure 1:
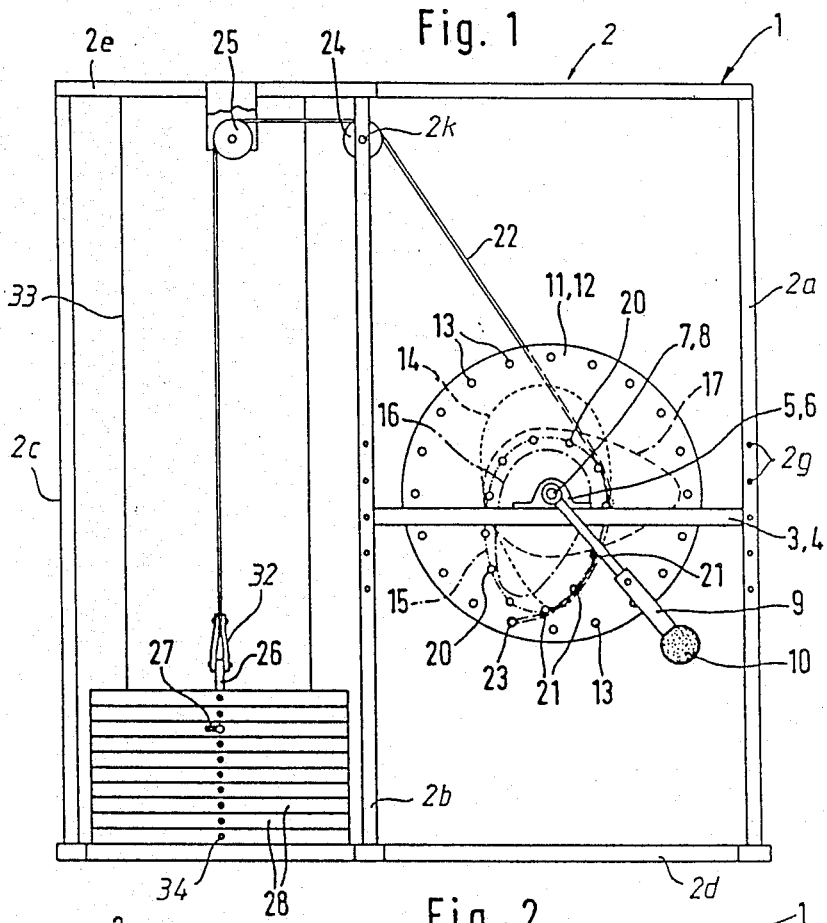
FIG. 1 is a side view of one embodiment of an exercising apparatus according to the invention.
Figure 3:
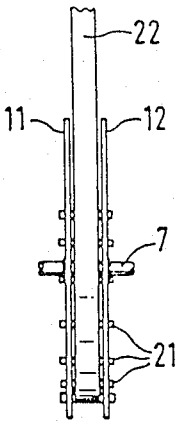
FIG. 3 is a fragmentary right side view of the exercising apparatus illustrating the intermediate support.
Figure 2:
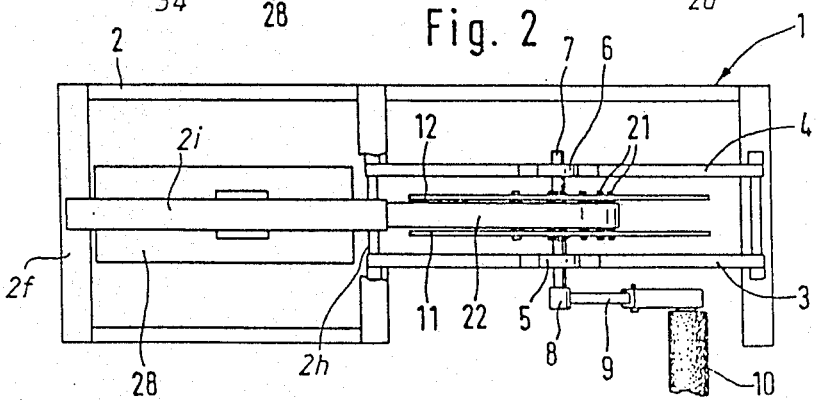
FIG. 2 is a top view of the exercising apparatus.

SPECIFIC DESCRIPTION Referring firstly to FIGS. 1 and 2, there is shown one embodiment of an exercising apparatus generally designated by reference numeral 1 and having an arbitrarily structured frame 2 which in the present nonlimiting example includes three pairs of upstanding frame members 2*a*,2*b*,2*c* connected to a base frame 2*d* and a top frame 2*e*. Each of the pairs of frame members 2*a*,2*b*,2*c* is maintained in spaced-apart relationship by suitable tie bars 2*f*.

As is shown in FIG. 1, the frame members 2*a*, 2*b* are provided with a plurality of spaced bores 2*g* which are engagable by crossbars 2*h* so that the level of the latter can be adjusted accordingly. Extending between the parallel crossbars 2*h* is a pair of struts 3, 4 which support a shaft 7 in respective bearings 5,6. The shaft 7 has one end 8 attached to a crank 9 which carries a padded roller 10 extending transversely to the crank 9 and essentially parallel to the shaft 7. The padded roller 10 projects laterally beyond the frame members 2*a*, 2*b* at a sufficient length so that the user can conveniently actuate the roller 10 for exercising the hands and legs or other muscles. Although not shown in the drawing, seating or lying accommodations for the user are certainly also provided.

Fixedly connected to the shaft 7 is a pair of spaced identical disks 11, 12 provided about their circumference with a plurality of apertures 13. By means of a tie bolt 23 one end of a cable or band 22 is fixed in a respective one of the apertures 13 as will be explained hereinbelow. Instead of using a tie bolt 23, it is certainly feasible to employ other suitable fastening means as e.g. hooks, slots, clamps etc.

The other end of the cable 22 is connected to a selector bar 26 by means of a clamp 32. The selector bar 26 is arranged between a spaced upright pair of parallel weight guide rods 33 which extend between an upper frame member 2*i* and the base frame 2*d*. The guide rods 33 extend through a stack of weight plates 28 which are slidable on the guide rods 33 and on the upright selector bar 26. Each of the weight plates 28 is provided with a central horizontal bore 34 adapted to receive a cranked key 27 extending inwardly from the front face of the weights 28 and is provided to engage appropriate horizontal bores in the selector bar 26. Depending on the position of the key 27, actuating the padded roller 10 will lift all of the weights 28 above the key 27 while leaving the others undisturbed.

As is especially shown in FIG. 1, in accordance with the present invention, the disks 11, 12 are provided with a plurality of aligned holes 20 which are spaced along distinct curved or cam paths 14,15,16,17. The cam paths 14–17 extends eccentrically with respect to the axis as defined by the shaft 7 and guide the cable 22 between the selector bar 26 and its attachment to the disks 11,12 by the tie bolt 23. In FIG. 1, only the holes along cam path 15 are shown while the other cam paths 14,16,17 are indicated by respective broken lines. It should be pointed out that any number of cam paths is feasible in order to increase the versatility of the exercising apparatus. Moreover, the arrangement of the holes is also not limited, i.e. the holes may be uniformly spaced or provided at varying distances and arranged in radial and in any other direction.

Figure 4:
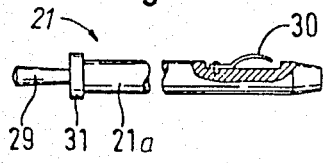
FIG. 4 is a fragmentary sectional view on an enlarged scale of one embodiment of a locking pin of the exercising apparatus.
Figure 4A:
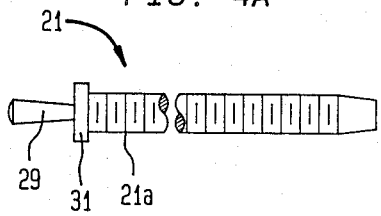
FIG. 4*a* is a fragmentary sectional view on an enlarged scale of a second embodiment of a locking pin of the exercising apparatus.

The individual cam paths 14–17 are represented or defined by locking pins 21 which are insertable through the aligned holes 20. As is especially illustrated in FIG. 4, each locking pin 21 is provided with a handle 29 and a collar 31 at the junction to the shank 21*a*. To prevent a loosening of the locking pins 20 is axial direction when being inserted into the holes 20, the shanks 21*a* of the locking pins 21 are each provided with a leaf spring 30. Alternately, the collar 31 can be a magnetic collar or may be equipped with catch springs, respective threads as illustrated in FIG. 4*a* or any other suitable fixing means which maintain the locking pins 21 in their secured position.

Figure 5:
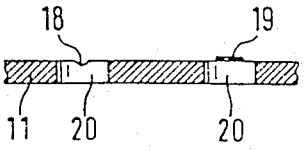
FIG. 5 is a cross sectional view on an enlarged scale of a punched disk of the exercising apparatus.

Each cam path 14–17 allows a training of a specific muscle in a controlled and suitable manner as the shape of the cam paths 14–17 is adjusted to the respective muscle strengths when exercising the respective body parts. To indicate to the user which cam path 14–17 is suitable for exercising a specific muscle, at least one of the disks 11, 12 e.g disk 11 as shown in the illustration of FIG. 1 is accordingly marked. The marking can be provided in various manner. As illustrated in FIG. 5, along one cam path respective grooves 18 are arranged while another cam path is marked by adhesive strips as indicated at 19. In addition, the cam paths may also be designated by color strips, beads or any other suitable means allowing the user to read and decide instantly which cam path 14–17 is needed to work out the desired muscle.

Extending between the upper portion of the frame members 2*b* is a further bar 2*k* which centrally supports a pulley 24. The pulley 24 guides the cable 22 towards a further pulley 25 which deflects the cable 22 towards the selector bar 26. The pulley 25 is supported by the upper frame member 2*i* which extends centrally between the frame members 2*b*,2*c*.

Exercising the legs or arms or other muscle sections requires the adjustment of the disks 11, 12 to various levels. This can be done by engaging the crossbars 2*h* in the respective bores 2*g* of the frame members 2*a*, 2*b* so that the position of the shaft 7 and thus the disks 11,12 are accordingly adjusted. In addition, it is advantageous to allow a changing of the length of the crank 9 e.g. by allowing an outer sleeve of the crank to slide within an inner part and securing the set position by a pin. The crank 9 may also be angularly adjustable and/or exchangeable to enhance comfort and use during operation. It is certainly also feasible to adjust the seating and lying accommodations instead of the disks 11,12. During operation of the exercising apparatus 1, the user selects the appropriate cam path for exercising a desired muscle by inserting the locking pins 21 into the respective aligned holes 20 of the disks 11, 12. The end of the cable 22 is fixed in the appropriate aperture 13 by tie bolt 23. Consequently, depending on the moment arm effective with respective to the shaft 7 and thus the crank 9 and padded roller 10, different forces are necessary to lift the weight load as selected by the cranked key 27 i.e. that the amount of force applied by the user to the padded roller 10 for lifting the weight plates 28 differs essentially from the amount of weight provided by the plates 28 depending on the course of the cam paths 14–17 and the respective moment arms. The various cam paths with the varying moment arms during lifting or retracting of the weight plates 28 allow the user to sepcifically exercise the muscles in dependence on their capability without risking overstress which may lead to torn muscles or the like.

While the invention has been illustrated and described as embodied in an Exercising Apparatus, it is not intended to be limited to the details shown since various modifications and structural changes may be made without departing in any way from the spirit of my present invention.

What is claimed as new and desired to be protected by Letters Patent is set forth in the appended claims:

1. Exercising apparatus, comprising:
   - a frame;
   - a user-actuated member connected to said frame;
   - weight means for providing resistance during an exercise;
   - force transfer means operatively connected to said weight means and to said user-actuated member; and
   - adjusting means for providing varying moment arms to allow a modification of the resistance as provided by said weight means without changing the initial position of said user-actuated member, said adjusting means being interposed between said force transfer means and said user-actuated member and selectively defining a plurality of paths for guiding said force transfer means to allow each muscle of a human body to be exercised according to its capability in each phase of motion.

2. Exercising apparatus as defined in claim 1 wherein said adjusting means includes a plurality of locking pins spaced along said paths for guiding said force transfer means.

3. Exercising apparatus as defined in claim 2 wherein said user-actuated member includes a shaft supported by said frame and a crank connected to said shaft.

4. Exercising apparatus as defined in claim 3 wherein said adjusting means further includes a pair of disks arranged in spaced-apart relationship and supported on said shaft, said disks being provided with a plurality of aligned holes defining said paths, said locking pins being selectively insertable in said holes.

5. Exercising apparatus as defined in claim 2 wherein said paths are curved paths extending eccentrically about said shaft.

6. Exercising apparatus as defined in claim 4, and further comprising fixing means for securely engaging said locking pins within said holes.

7. Exercising apparatus as defined in claim 6 wherein said fixing means includes a collar attached to said locking pins and made of magnetic material.

8. Exercising apparatus as defined in claim 6 wherein said fixing means includes catch springs extending at a forward section of said locking pins.

9. Exercising apparatus as defined in claim 4 wherein each of said locking pins is provided with a threaded section to securely fix said locking pins within said holes.

10. Exercising apparatus as defined in claim 4 wherein said force transfer means is a cable having one end connected to said weight means and another end, said disks being provided with aligned apertures spaced along the periphery of said disks, and further comprising a tie bolt connected to said other end of said cable, said other end of said cable being attached to said disks by inserting said tie bolt into respectively aligned apertures.

11. Exercising apparatus as defined in claim 10, and further comprising at least one pulley, said cable extending from said paths via said pulley towards said weight means.

12. Exercising apparatus as defined in claim 3, and further comprising marking means applied on said adjusting means for identifying each of said paths and for informing a user as to which muscle is exercised.

13. Exercising apparatus as defined in claim 12 wherein said marking means includes color strips.

14. Exercising apparatus as defined in claim 12 wherein said marking means includes adhesive tapes.

15. Exercising apparatus as defined in claim 12 wherein said paths are marked by respective grooves.

16. Exercising apparatus as defined in claim 3 wherein said shaft is arranged in said frame in a height-adjustable manner.

17. Exercising apparatus as defined in claim 3 wherein said crank is telescopically extendable by sliding an inner part within an outer part.

* * * * *